US009565887B2

(12) United States Patent
Shapiro

(10) Patent No.: US 9,565,887 B2
(45) Date of Patent: Feb. 14, 2017

(54) SWEAT DIVERTER

(71) Applicant: Rosecroft Components, Inc., San Francisco, CA (US)

(72) Inventor: James Shapiro, San Francisco, CA (US)

(73) Assignee: Rosecroft Components, Inc., San Francisco, CA (US)

( * ) Notice: Subject to any disclaimer, the term of this patent is extended or adjusted under 35 U.S.C. 154(b) by 300 days.

(21) Appl. No.: 14/351,442

(22) PCT Filed: Oct. 10, 2012

(86) PCT No.: PCT/US2012/059549

§ 371 (c)(1),
(2) Date: Apr. 11, 2014

(87) PCT Pub. No.: WO2013/055787

PCT Pub. Date: Apr. 18, 2013

(65) Prior Publication Data

US 2014/0289932 A1 Oct. 2, 2014

Related U.S. Application Data

(60) Provisional application No. 61/546,420, filed on Oct. 12, 2011, provisional application No. 61/592,457, filed on Jan. 30, 2012.

(51) Int. Cl.

| | |
|---|---|
| ***A42C 5/02*** | (2006.01) |
| ***A41D 20/00*** | (2006.01) |
| ***A42B 1/00*** | (2006.01) |

(52) U.S. Cl.

CPC ..... *A42C 5/02* (2013.01); *A41D 20/00* (2013.01); *A42B 1/00* (2013.01)

(58) Field of Classification Search

CPC ..... A42C 5/00; A42C 5/02

(Continued)

(56) References Cited

U.S. PATENT DOCUMENTS

| | | | |
|---|---|---|---|
| 1,392,539 | A | 10/1921 | Tipograph |
| 1,496,285 | A | 6/1924 | Arond |

(Continued)

FOREIGN PATENT DOCUMENTS

| | | | |
|---|---|---|---|
| WO | WO-2005/025350 | A1 | 3/2005 |
| WO | WO-2011/046988 | A2 | 4/2011 |

(Continued)

OTHER PUBLICATIONS

International Search Report mailed on Feb. 26, 2013 for PCT Patent Application No. PCT/US2012/059549, filed on Oct. 10, 2012, four pages.

(Continued)

*Primary Examiner* — Gloria Hale
(74) *Attorney, Agent, or Firm* — Cooley LLP

(57) ABSTRACT

Described herein are sweat-diverting devices which can be adhered to a wearer by an adhesive. The sweat-diverting devices described here may be adhered over a portion of the face without circumscribing the head. Such sweat-diverting devices may comprise one or more curves or other features that conform to the facial features of the wearer. In some variations, a sweat-diverting device is configured to be worn at various heights on the forehead, over or under the brow line, and/or over the eyes. A sweat-diverting device can also be used in pairs, for example, where one device is positioned over each eye. Sun-shading devices, with or without sweat-diverting features, are also described.

20 Claims, 14 Drawing Sheets

(58) Field of Classification Search
USPC .... 2/181, 181.2, 181.4, 181.6, 181.8, 182.8, 2/174, 170, 171, 182.2, 182.3, 182.5, 2/182.6, 182, 7, 171.3, 10, 11, 15; 132/212
See application file for complete search history.

(56) References Cited

U.S. PATENT DOCUMENTS

| | | | | |
|---|---|---|---|---|
| 1,612,267 | A | 12/1926 | Dickson | |
| 2,331,545 | A | 10/1943 | Gano, Jr. | |
| 4,021,859 | A | 5/1977 | Burke | |
| 4,258,437 | A | 3/1981 | Sawatsky | |
| 4,547,903 | A | 10/1985 | Brown et al. | |
| 4,626,247 | A | 12/1986 | Frankel | |
| 4,638,512 | A | 1/1987 | Frankel | |
| 4,856,116 | A | 8/1989 | Sullivan | |
| 5,129,103 | A | 7/1992 | Gruneisen | |
| 5,146,630 | A | 9/1992 | Richard | |
| 5,740,556 | A | 4/1998 | Brown | |
| 5,781,932 | A | 7/1998 | Brown | |
| 5,926,849 | A | 7/1999 | Boyle | |
| 6,026,518 | A | 2/2000 | Brown | |
| 6,108,818 | A | 8/2000 | Eisenberg | |
| 6,332,225 | B1 | 12/2001 | Casey | |
| 6,353,936 | B2 | 3/2002 | Flatt | |
| 6,567,991 | B1 | 5/2003 | Holslag et al. | |
| 6,584,984 | B2 | 7/2003 | Kelly | |
| 6,971,122 | B2 | 12/2005 | Sanchez | |
| 7,398,559 | B2 | 7/2008 | Flatt | |
| 7,681,252 | B1 | 3/2010 | Petry | |
| 8,296,866 | B2 | 10/2012 | Kelly | |
| 9,009,869 | B1 * | 4/2015 | Shapiro | A41D 20/00 2/181 |
| 2001/0047536 | A1 | 12/2001 | Flatt | |
| 2003/0041365 | A1 | 3/2003 | Sanchez | |
| 2006/0010568 | A1 | 1/2006 | Wiles | |
| 2007/0079423 | A1 | 4/2007 | Flatt | |
| 2008/0086792 | A1 | 4/2008 | Kuracina et al. | |
| 2009/0077716 | A1 | 3/2009 | Farney | |
| 2010/0107306 | A1 * | 5/2010 | Kuracina | A41D 20/00 2/181 |
| 2012/0036613 | A1 | 2/2012 | Calon et al. | |
| 2012/0216332 | A1 | 8/2012 | Wooley | |
| 2012/0312445 | A1 | 12/2012 | Kuracina et al. | |
| 2013/0005552 | A1 | 1/2013 | Kuracina et al. | |
| 2013/0097765 | A1 | 4/2013 | Kuracina et al. | |
| 2014/0289932 | A1 * | 10/2014 | Shapiro | A41D 20/00 2/181 |
| 2015/0143615 | A1 | 5/2015 | LePage | |
| 2015/0208742 | A1 * | 7/2015 | Shapiro | A41D 31/00 2/171 |

FOREIGN PATENT DOCUMENTS

| | | | |
|---|---|---|---|
| WO | WO-2011/046988 | A3 | 4/2011 |
| WO | WO-2013/055787 | A1 | 4/2013 |
| WO | WO-2013/159197 | A1 | 10/2013 |
| WO | WO-2015/099848 | A1 | 7/2015 |

OTHER PUBLICATIONS

International Search Report mailed on Mar. 2, 2015, for PCT Patent Application No. PCT/US2014/055650, filed on Sep. 15, 2014, four pages.
Written Opinion of the International Searching Authority mailed on Feb. 26, 2013 for PCT Patent Application No. PCT/US2012/059549, filed on Oct. 10, 2012, five pages.
Written Opinion of the International Searching Authority mailed on Mar. 2, 2015, for PCT Patent Application No. PCT/US2014/055650, filed on Sep. 15, 2014, five pages.
U.S. Appl. No. 14/396,666, filed Oct. 23, 2014, by LePage.
U.S. Appl. No. 14/486,746, filed Sep. 15, 2014, by Shapiro et al.
AU Application No. 2012323265, Notice of Acceptance, dated May 12, 2016.
AU Application No. 2012323265, Patent Examination Report No. 1, dated May 15, 2015.
AU Application No. 2012323265, Patent Examination Report No. 2, dated Apr. 1, 2016.
Australian Office Action mailed on Apr. 26, 2016, for Australian Patent Application No. 4. 2012323265, filed on Oct. 10, 2012, 6 pages.
Extended European Search Report mailed on Dec. 17, 2015, for EP Application No. 12 839 785.8, filed on Oct. 10, 2012, 10 pages.
Partial Supplementary European Search Report mailed on Aug. 31, 2015, for EP Application No. 12 839 785.8, filed on Oct. 10, 2012, 5 pages.
European Communication mailed on Nov. 17, 2016, for EP Application No. 12 839 785.8, filed on Oct. 10, 2012, 4 pages.

* cited by examiner section A-A section B-B

SWEAT DIVERTER

CROSS REFERENCE TO RELATED APPLICATIONS

This application is a U.S. National Phase application under 35 U.S.C. §371 of International Application No. PCT/US2012/059549, filed on Oct. 10, 2012, which designated the United States and which claims priority to U.S. Provisional Patent Application Ser. No. 61/546,420, filed on Oct. 12, 2011 and 61/592,457, filed on Jan. 30, 2012, the disclosures of all of which are hereby incorporated by reference herein in their entirety.

BACKGROUND

When undertaking an activity causing sweating, a person can suffer from the effects of sweat dripping into his eyes. Many devices have been developed to address this problem, such as absorbent sweatbands. Such devices fail to prevent sweat from reaching the eyes once they become saturated, and must be dried or wrung out in order to restore their effectiveness. Other types of sweat headbands, e.g., sweat-diverting headbands, have also been developed in order to address the problem of sweatband saturation and resultant inability to prevent additional sweat from reaching the eyes. These other types of sweat headbands, to remain effective, must be remain in tight apposition to the forehead, which may require an uncomfortably tight fit of the headband around the wearer's head. Accordingly, improved devices for addressing problems caused by sweat may be desirable.

BRIEF SUMMARY

Described herein are sweat-diverting devices which may be affixed to a wearer by an adhesive, such as a pressure-sensitive adhesive. A sweat-diverting device may comprise one or more curves that conform to the facial features of the wearer, and/or may comprise one or more reinforcing members to help maintain the shape of the device. In one variation, a sweat-diverting device may comprise one or more curves having a radius of curvature that approximates the radius of curvature of the orbital region of the face. Sweat-diverting devices may also have one or more curves that conform to the curvature of the glabella. In some variations, the sweat-diverting device may have pre-shaped curves, and/or may be made of a conformable material that allows the curves of the device to be adjusted as it is applied to the wearer. The sweat-diverting devices described herein may have any number of curves with various degrees of curvature as may be desirable for conforming to the anatomy of the wearer.

A sweat-diverting device may be reusable, with an adhesive reapplied for each wearing, or may be single use and disposable, with the adhesive integrated with the device during manufacturing. The device may assume a variety of shapes, including but not limited to a linear and/or curved shape (e.g., a combination of linear and curved contours). The device may also be discontinuous and used in pairs, for example, for use over each eye. It may also be configured to be worn at various heights on the forehead, over or under the brow line. In some variations, the sweat-diverting device may be adhered over a portion of the face without circumscribing the head.

One variation of a wearable sweat-diverting device may comprise legs defining a generally U-shaped channel with an adhesive backing, wherein the adhesive is protected or covered by a release liner until the device is ready to be applied to the wearer's forehead. The device may be long enough so that, when applied to the wearer's forehead, it may span both eyes, such that sweat, when diverted from dripping from the forehead toward the eyes, exits the device laterally displaced from the wearer's eyes. Such a device may be affixed to the forehead so that the highest point of the device, relative to the vertical dimension of the forehead, is generally centered over the eyes (e.g., at the center of the forehead). Sweat captured in the channel will then flow downward and outward in the channel to its termination, where it flows down the wearer's face. Such a configuration may allow the device to be placed closer to the eyes than a circumferentially fitting sweat-diverting headband, since the device is not required to follow a substantially linear path (in contrast to a headband). Further, use of the adhesive as the attachment mechanism may render it more comfortable to wear than a circumferentially fitted sweat-diverting headband, which must be worn tightly enough to maintain apposition of the sweat capturing channel to the forehead.

Another variation of a wearable sweat-diverting device may be specifically configured to fit between the eyebrows and the eyes, for example, in the orbital region of the eyes. Such a device may have a shape bias to fit over the bridge of the nose and along the orbital portion of the face until terminating laterally displaced from the eyes. Such a variation may also comprise a generally U-shaped channel with a single use adhesive backing, covered by a protective liner until ready for use.

Another variation of a wearable sweat-diverting device may comprise a pair of separate adhesive backed, generally U-shaped channels configured to fit over the individual eyes of the wearer. Such a device may assume a curved shape, such that the center of each is affixed to the forehead above the eyebrows, with the lateral side extending past the eye and the medial side extending to the nose. Sweat captured in the channel may flow out of the device on the lateral side down the wearer's face laterally displaced from the eye, and on the medial side down the nose and medially displaced form the eye. The medial end of such a variation may also be long enough, and shaped, to terminate above, at or below the level of the eye so that sweat from skin in those areas may also be prevented from reaching the eyes. Such an arrangement may be beneficial since in windy conditions, or conditions such as during bike riding where rapid forward movement would create a breeze directed at the wearer's face, sweat produced at or even below eye level might otherwise reach the eyes.

Another variation of a wearable sweat-diverting device may be configured similarly to the description in the immediately preceding paragraph, but shaped and sized for placement completely below the eyebrows. In such a variation, the device may be positioned to have a greater catchment area than devices placed a greater distance from the eyes.

The channels of the sweat-diverters described herein may have any suitable cross-sectional geometry. They may be generally U-shaped, generally V-shaped, or the like. In addition, the legs of the diverter that form the channel may or may not be the same length, and may or may not terminate at the same height. In addition, the space between the legs may be varied to provide a larger or smaller channel.

In other variations, the cross-section of a sweat-diverting channel may have curves designed to perform multiple functions. For example, a segment of the cross section in contact with the wearer may be angled to slope in a downward direction in order to facilitate the flow of sweat into the device, and another adjacent segment may then curve upward to form a channel to capture and divert sweat, and another adjacent segment may curve back inward toward the wearer in order to help retain the sweat within the device so that it may be diverted. In one such variation, a sweat-diverting channel may be generally U-shaped in cross section, with an inward facing lip provided to further reduce the likelihood that captured sweat may escape the channel in an unintended direction.

In other variations, the sweat-diverting channels may take a combination of forms or cross-sections. For example, the cross-sectional shape of a sweat-diverting channel may vary along the length of the channel. In some variations, a center portion of the channel may comprise an open lumen configured for collecting sweat, and a side portion of the channel may comprise a closed lumen configured for diverting sweat away from the eyes. In one such variation, in the case of a sweat-diverting channel that adheres to the area between the eyebrows, the portion of the diverting channel which runs in a vertical direction may have a partially or fully enclosed circular cross section, so that sweat which has been collected and diverted cannot escape onto the nose, where it may irritate or tickle the wearer. Such an enclosed or other portion of the channel may be configured not to adhere to the wearer's face, so the sweat may be deposited out the end of the channel away from the wearer's face. For example, a sweat-diverting channel may comprise a bendable portion, wherein the bendable portion may comprise a series of pleats such that the sweat-diverting channel may be deflected.

Other variations of a wearable sweat-diverting device may have segments which are not adherent and traverse areas such as hair to deposit diverted sweat to other areas where diverted sweat may not irritate the wearer. Such variations may be configured to fit around the ears in the manner of eyeglasses, depositing diverted sweat behind the ears or on the back of the neck.

In other variations, a sweat-diverting channel may incorporate an absorbent or wicking material within the channel, such that the captured sweat may not escape the channel and may be directed toward the outlet ends by wicking action. An absorbent or wicking material may also be incorporated into a sweat-diverting device at a location outside the channel, to capture or direct sweat away from the eyes.

In some variations a sweat-diverting channel may be at least partially covered by a filter or membranous material that may permit the flow of sweat into the channel and reduce the likelihood that captured sweat may escape the channel in an unintended direction.

In some variations of a wearable sweat-diverting device, an adhesive may be incorporated into the device at the time of manufacture and covered with a protective backing or release liner, such that the backing may be removed to expose the adhesive prior to use. Such adhesives may cover only certain areas of a sweat-diverting device for optimal adhesion to the wearer. In other variations a sweat-diverting device may incorporate an adhesive flexible fabric or film which may aid in securement of the device to the wearer. In such variations incorporating an adhesive applied at the time of manufacture may be disposable and intended for single use only.

In other variations, a sweat-diverting device may be intended for multiple uses before disposal. In such variations an adhesive mechanism may be supplied as a separate component which may be applied prior to use. In some variations, an adhesive mechanism may be a flexible fabric, film or membranous strip similar to an adhesive bandage with adhesive on one side, wherein a backing material protects the adhesive until the backing is removed for use. In such variations the backing may be removed and the strip applied to the sweat-diverting device and to the wearer. In some such variations the backing material may have more than one part, so that only a portion of the adhesive is exposed by removal of any of the parts, facilitating application of the adhesive to the device and then to the wearer. In other variations the adhesive mechanism may have adhesive on both sides, with backing material covering each. In such variations the backing may first be removed from one side of the adhesive mechanism and the exposed adhesive may be applied to the sweat-diverting device or the wearer. The backing may then be removed from the other side, exposing the other adhesive surface, and the device applied to the wearer. In other variations, the adhesive mechanism may be in a liquid, gel or paste and applied from an applicator to the sweat-diverting device, the wearer or both.

Described herein are several shapes, lengths, intended anatomical placement, cross sections, materials and adhesive mechanisms. These examples are for illustrative purposes and are not intended to limiting. Also, the variations described herein may contain certain combinations of the attributes (e.g., curves, lengths, widths, shapes, etc.) described herein. Such combinations are illustrative and not limiting, and other combinations of the same attributes are intended to be included in this description. It should also be understood that one or more of these attributes may also serve aesthetic or fashion purposes, such as providing a streamlined, fearsome or feature-accentuating appearance.

DESCRIPTION OF THE DRAWINGS

FIG. 2B depicts a cross-section of the sweat-diverting device of FIG. 2A taken along the line A-A. FIG. 2C depicts a cross-section of a sweat-diverting device at any location along its length.

DETAILED DESCRIPTION

Figure 1A:
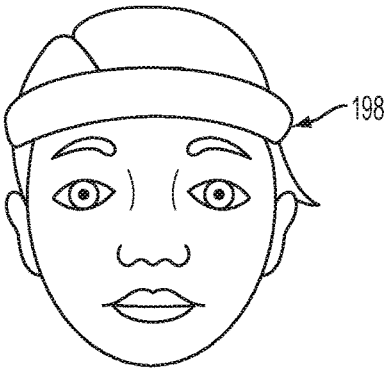
FIG. 1A PRIOR ART
FIG. 1A depicts a sweatband fitted on a wearer.

Described herein are several variations of a wearable sweat-diverting device, coupled to the wearer by a temporary adhesive mechanism. A sweat-diverting device adhered to the wearer may have several advantages over both absorbent headbands and non-absorbent sweat-diverting headbands. For example, a sweat-diverting device affixed to the wearer by a temporary adhesive such as that used in an adhesive bandage may be more comfortable to wear than a sweat-diverting headband. A sweat-diverting device held in place by an adhesive need only cover the area necessary to capture and redirect sweat, rather than circumferentially around the head. As a result, it may eliminate or mitigate problems associated with an uncomfortably tight headband fit, binding or pulling on the hair or reducing blood flow and creation of a temporary unsightly impression even after removal of a headband.

A sweat-diverting device adhered directly to a wearer may also be more effective at capturing and diverting relevant sweat which might otherwise flow or drip to the eyes. Such a sweat-diverting device may be placed such that less skin, and thus source of sweat, is exposed between the device and the eyes. In addition, a sweat-diverting device which is adhered to the wearer may be more effective at diverting sweat. A headband-based sweat diverter must be made of material strong enough to be held tightly about the head and as such needs to be thicker than an adherent sweat-diverting device. As a result of the greater thickness it may create a more substantial barrier, allowing sweat to collect above it before it drips into a collection and redirecting channel. Such larger drips may be more prone to dripping over the collection channel. In the case of a sweat-diverting device adhered directly to the wearer, the diverting channel may be formed partly by the skin of the wearer, presenting no barrier to the flow of sweat into the channel. In the case of a sweat-diverting device adhered directly to the wearer and in which the diverting channel is not formed partly by the skin of the wearer, there is nonetheless a lesser barrier than may be required by a sweat-diverting headband.

A sweat-diverting device adhered directly to the wearer may also divert sweat more effectively by enabling the diverting channel to take any convenient shape rather than to be constrained by the substantially linear shape required for a sweat-diverting headband. A sweat-diverting device adhered directly to the wearer may channel sweat downward around the eyes, rather than just laterally displaced, but still above, the eyes as in the case of a substantially linear portion of a headband. In some circumstances, such as biking, the wearer may hold his head in a downwardly inclined position. In such cases the sweat captured in a headband device would be biased to flow to the center of the forehead where it may overflow the channel. A sweat-diverting device adhered directly to the wearer may be positioned such that the lateral ends of the channel may be sloped downward from the center, allowing outflow in the desired area.

Figure 1B:
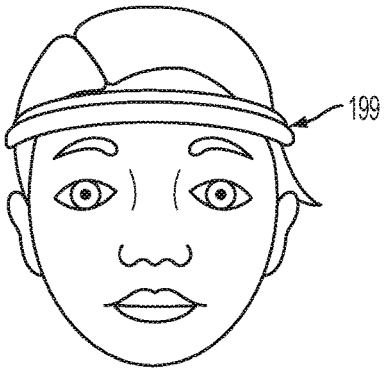
FIG. 1B PRIOR ART
FIG. 1B depicts a sweat-diverting headband fitted on a wearer.
Figure 1C:
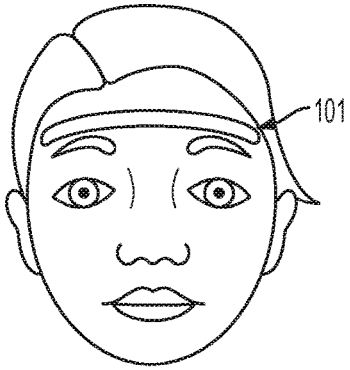
FIG. 1C depicts an adhesive sweat-diverting device fitted on a wearer.

FIGS. 1A-1C depict various devices intended to prevent flow of sweat into the eyes. FIG. 1A depicts an illustrative prior art sweatband (198), which may be exemplary of an absorbent garment used to retain sweat until it becomes saturated. FIG. 1B depicts a prior art sweat-diverting headband (199), which represents a circumferential headband approach to prevention of sweat flow to the eyes. FIG. 1C depicts one variation of a suitable wearable adhesive sweat-diverting device (101) as described hereinthroughout, that may be worn above the eyes to capture and divert sweat from reaching the eyes.

Suitable sweat-diverting devices are described in detail hereinthroughout. However, in general, the sweat-diverting devices described herein can take many forms. They may have a variety of cross-sectional configurations and shapes, be made of a variety of suitable materials, and may contain one or more additional useful features. They may also be placed in a variety of suitable locations on the face to divert sweat away from the eyes of the wearer (e.g., above the eyebrow, below the eyebrow and above the eye, etc.) and be adjusted before or during use. In addition, the sweat-diverting devices described here may be configured for a single-use and be disposable, or may be configured for more than one use and be reusable. The sweat-diverting devices may also include one or more distinctive or ornamental elements, for example, coloring, logos, or other branding. Wearable adhesive sweat-diverting devices may be supplied in lengths or coils such that a desired length may be cut off of the length or coil prior to use. The wearable sweat-diverting devices may also be configured for use with, or be coupled to, one or more devices capable of providing shade from the sun.

Figure 2A:
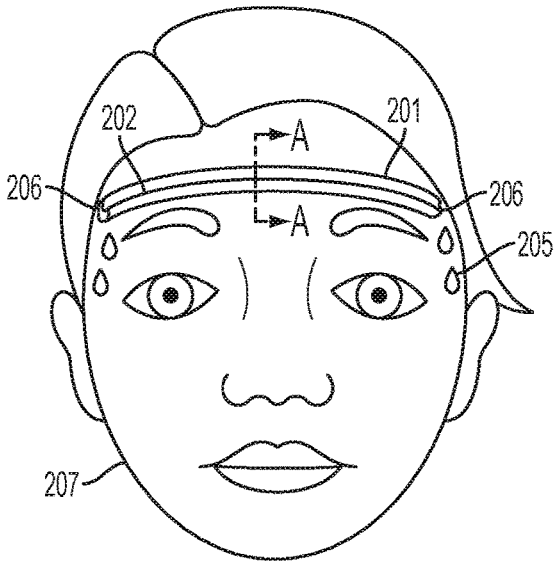
FIGS. 2A-2C depict one variation of a sweat-diverting device as described herein.
Figure 2B:
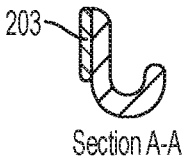
Figure 2C:
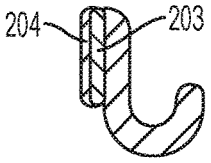

FIGS. 2A-2C depict one variation of an adhesive wearable sweat-diverting device (201). In the variation depicted here, the sweat-diverting device may be made of a flexible material and have a generally U or J-shaped cross section (section A-A), as illustrated in FIG. 2B. A collection channel (202) may capture sweat as it drips down the skin above the wearer's eyes. The device may be coupled to the wearer by an adhesive (203), which may be covered by a protective backing material (204) or release linear prior to use, as shown in FIG. 2C. Sweat (205) may drip into the channel (202), where it may flow to the ends (206) and down the wearer's face (207) away from the eyes. The device (201) may adhere to the wearer's face without fully circumscribing the head, and without any direct communication of one end of the device with another end of the device. For example, the device may be have a length suitable for spanning from ear to ear, temple to temple, eyebrow to eyebrow, or some length in between. In some variations the device has a length of at least 4 inches inches. In other variations the device has a length of at least 5 or at least 6 inches.

Figure 2D:
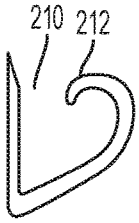
FIGS. 2D-2K depict illustrative cross-sections and additional features suitable for use with the sweat-diverting devices described herein.
Figure 2E:
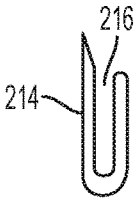
Figure 2F:
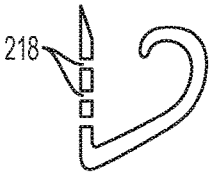
Figure 2G:
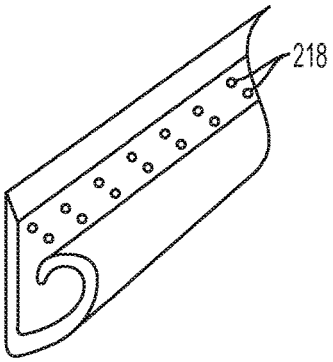
Figure 2H:
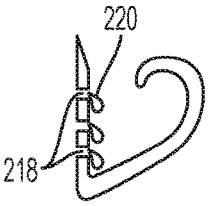
Figure 2I:
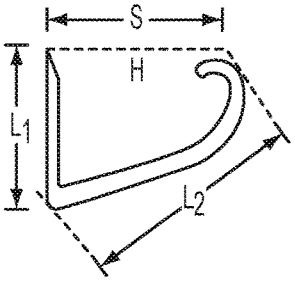
Figure 2J:
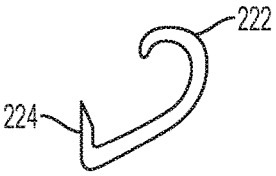
Figure 2K:
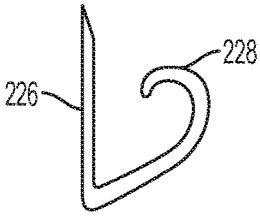

FIGS. 2D-2K depict various illustrative cross-sections of suitable for use with the sweat-diverters and devices described herein. For example, FIG. 2D provides a cross-sectional representation of diverter (210). In this variation, leg (212) curves inward. This may be useful, for example, in retaining collected sweat during head movement of the wearer, such as for example, when the wearer lowers or tilts his or her head. FIG. 2E provides another variation of a sweat-diverter (214) having a narrow opening (216), which may be useful, for example in drawing sweat into the diverter by capillary action. Opening (216) may be any suitable width capable of facilitating capillary action, e.g., between about 1 mm and about 4 mm. In addition, a sweat diverter may have one or more surface features such as grooves, raised ribs or absorbent elements placed along various portions of the device to promote channeling of sweat produced near the diverter to the ends of the device, where the sweat may then drip away from the eyes of the wearer. FIGS. 2F-2H depict another variation of a suitable sweat-diverter, here having multiple perforations or apertures (218) to facilitate outflow and capture of sweat (220) developed or collected behind the device. FIGS. 2F and 2H provide side views, while FIG. 2G provides a perspective view. While many apertures (218) are shown in this variation, any suitable number of apertures may be used. The apertures may be arranged in any suitable pattern, or may be random in their placement. FIGS. 2I-2K show illustrative dimensions for the sweat-diverter devices suitable for use herein. The spacing (S) between the legs may be configured to provide a wide spacing, and a larger channel, as depicted in FIG. 2I, or spacing (S) may be more narrow, for example, as depicted in FIG. 2K. Similarly, the lengths (L1 and L2) of the legs defining the channel may be the same, or may be different. In FIG. 2I the lengths (L1 and L2) are configured such that the ends of the legs terminate generally at equal height (H). In FIG. 2J, leg (222) extends beyond leg (224), while in FIG. 2K, leg (226) extends beyond leg (228).

Figure 3A:
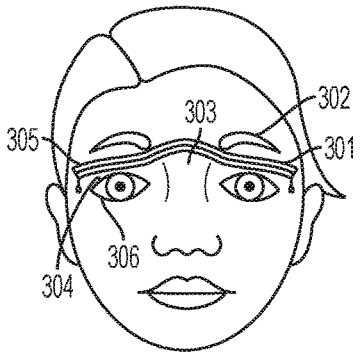
FIGS. 3A-3C depicts several variations of a sweat-diverting device fitted on a wearer.
Figure 3B:
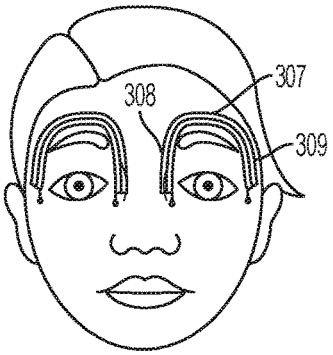
Figure 3C:
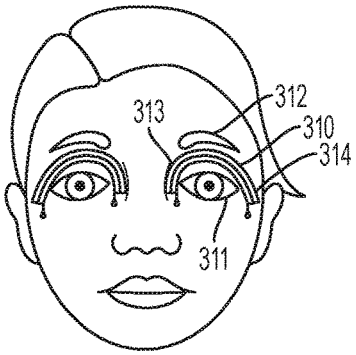

FIGS. 3A-3C depict additional variations of an adhesive sweat-diverting device. FIG. 3A depicts an adhesive wearable sweat-diverting device (301) that may be made of a flexible material and have one or more pre-shaped curves to fit around (e.g., above and/or below) a wearer's eyebrows (302). The device may have a first curve, a second curve, and a third curve, wherein the first and third curves have a radius of curvature that approximate the curvature of the orbits and the second curve has a radius of curvature that approximates the curvature of the glabella. For example, one or more curves may have a radius of curvature from about 0.25 inch to about 2 inches. The device may be contoured to fit over the bridge of the nose (303) and within the orbital sockets (304). The device may further be contoured to provide outlets, with or without tubing, for carrying captured sweat at its ends (305), away from the wearer's eyes (306). The length of the device may be such that the outlets extend laterally past the eyes. In some variations, the length of the device may be from about 4 inches to about 8 inches, for example, from about 4 to 5 inches, or from about 5 to 6 inches. The device may be pre-shaped to the approximate shape required, such that it will fit most face sizes. It may also be made of a flexible material to accommodate the exact contour of a given user's face. Such flexible material may also increase the ease of application and comfort of the wearer. The curvature of the various segments may be configured to slope generally from the middle of the device, downward to the ends of the device in order to maximize the gravitational flow of sweat to the ends of the device where it may exit the device away from the eyes of the wearer.

Suitable adhesive wearable sweat-diverting devices as described herein may also be configured to be worn above each individual eyebrow, for example, as shown in FIG. 3B. Such a device may configured to run medially (308) down the side of the nose, and laterally (309) down the side of the face displaced from the eye, with a curved segment in between. Such curved segment may enable the device to conform closely to the contours of the face. Such curves may also enable the device to fit close to the eye, such that as much of the wearer's skin as possible lies above the diversion device, thereby maximizing the catchment area for sweat collection and diversion. FIG. 3C depicts an adhesive wearable sweat-diverting device (310) that may be configured to be worn above each individual eye (311) and below the corresponding eyebrow (312). Such a device may be configured to run medially (313) down the side of the nose and laterally (314) down the side of the face displaced from the eye, with a curved portion in between. Such a curved portion may enable the device to be placed below the eyebrow, thereby maximizing the catchment area for sweat collection and diversion. The curvature of the device may further enable the medial segment (313) and lateral segment (314) to terminate at a level below the eye itself, such that gravity pulls sweat into the device above and around the eye and out of the device at a level below the eye. An adhesive wearable sweat-diverting device (310) may be shaped to have one or more curves which would allow it to conform to most faces, and it may further be flexible to allow it to conform precisely to a broad variety of face contours. As mentioned above, the adhesive wearable sweat-diverting devices may come in various sizes to fit various size faces or may be adjustable to comfort by the wearer.

The wearable adhesive sweat-diverting device may be made of one or more flexible materials or be made of one or more rigid materials. In some variations it is desirable for the sweat-diverting devices to be made of one or more flexible materials and have no pre-shaped curves such that the wearer may apply it to his or her face to conform it to his or her individual features. In these variations, the sweat-diverting devices may have a first, generally linear, configuration prior to application, and a second, contoured configuration after application, set by the preference and comfort of the wearer. Suitable flexible materials for use with the devices described herein include flexible silicones, EPDM, neoprene, various butadienes, various fluoroelastomers, various thermoplastic or thermoset elastomers, various vinyl esters, combinations thereof, and the like. Suitable ranges of flexibility may include materials having hardness of 50 durometer, Shore A or less. For example, suitable durometer ranges may be between about 5 and about 50, between about 7 and about 40, between about 10 and about 30, and the like. Flexibility of the device may be enhanced by segments of varying thickness, inclusion of small slits or other apertures, or the like. When slits are included, they may run less than all the way across the device and perpendicular to the length of the device, and may be of such size to enable shaping of the device without allowing fluid to escape through them. Such slits may be 0.1 mm to 2.0 mm in width. In addition or alternatively the device may contain scored sections to increase its flexibility and shapability.

Figure 3D:
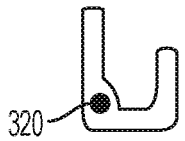
FIGS. 3D-3E depict illustrative variations of a sweat-diverting device comprising a reinforcing member.
Figure 3E:
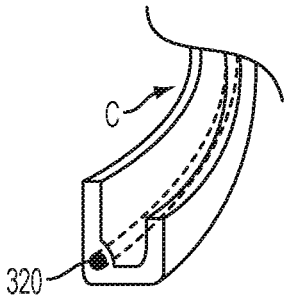

Alternatively, the sweat-diverting devices described herein may include one or more reinforcing members to help maintain the shape of the sweat-diverting device once shaped according to the wearer's preference and comfort level. For example, FIGS. 3D and E show a cross-sectional and perspective view respectively of one variation of a sweat-diverter having a reinforcing member (320). As shown there, reinforcing member (320) may be included to help shape the device prior to, or during use. In this variation, reinforcing member (320) is a wire that help maintains curve (C). While shown as a single reinforcing member, any suitable number of reinforcing members may be used. Similarly, while shown as a wire, reinforcing member may be any suitable member having greater rigidity than the diverter.

Figure 4A:
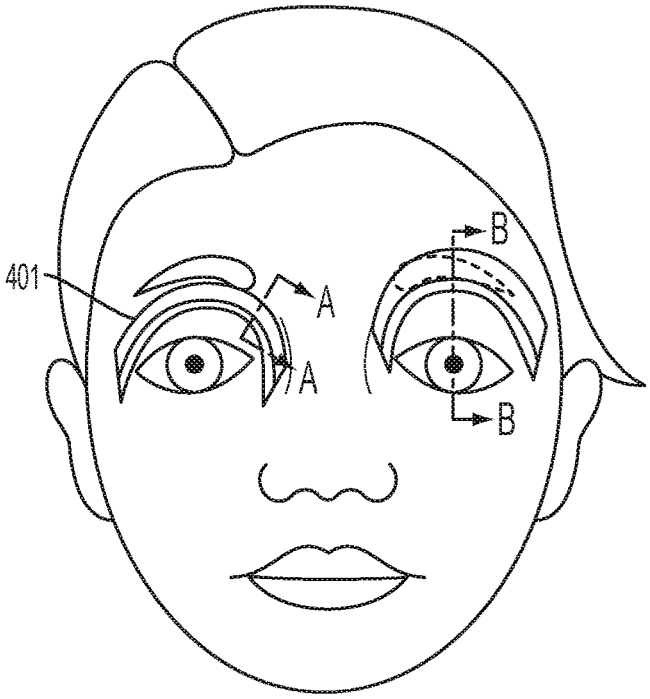
FIG. 4A depicts one variation of sweat-diverting devices that may be fitted over the eyes of a wearer.
Figure 4B:
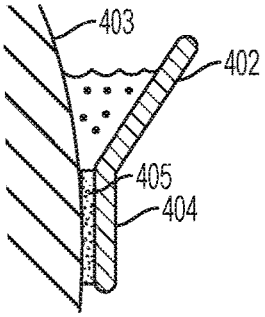
FIG. 4B depicts a cross-section of the sweat-diverting device of FIG. 4A taken along the line A-A.
Figure 4C:
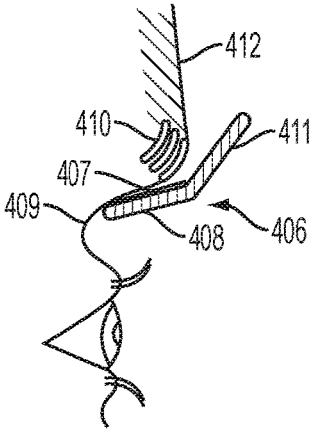
FIG. 4C depicts a cross-section of the sweat-diverting device of FIG. 4A taken along the line B-B.

FIGS. 4A-4C depict other variations of an adhesive wearable sweat-diverting device. Adhesive wearable sweat-diverting device (401) may be made of a flexible or rigid material and may or may not have one or more angles or curves. As shown in FIG. 4B (section A-A), when applied to the wearer, a first leg (402) may form one arm of a generally V-shaped sweat-diverting channel, and the wearer's skin (403) may form the other arm of the channel. A second leg (404) of an adhesive wearable sweat-diverting device may have adhesive backing (405) for attachment of the device to the skin. As shown in FIG. 4C (section B-B), an adhesive wearable sweat-diverting device (406) may have adhesive backing (407) on one leg (408) for coupling the device to the wearer's skin (409). The adhesive backing (407) may be positioned on one leg (408) such that the leg may extend away from the skin without sticking to a facial feature such as an eyebrow (410). A second leg (411) of an adhesive wearable sweat-diverting device may extend at an angle from the first arm to form a barrier against the flow of sweat and one side of a sweat-diverting channel. The wearer's skin (412) may form another side of the sweat-diverting channel.

Figure 5A:
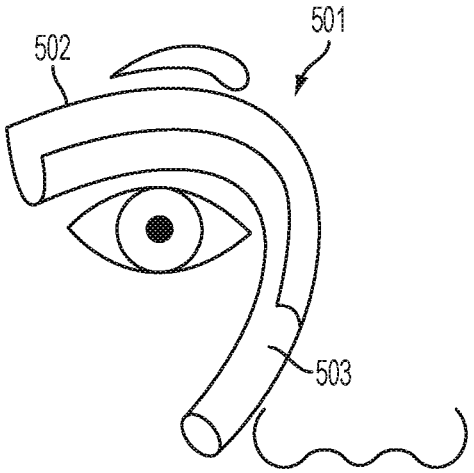
FIGS. 5A and 5B depict other variations of sweat-diverting devices that may be positioned over the eyes.
Figure 5B:
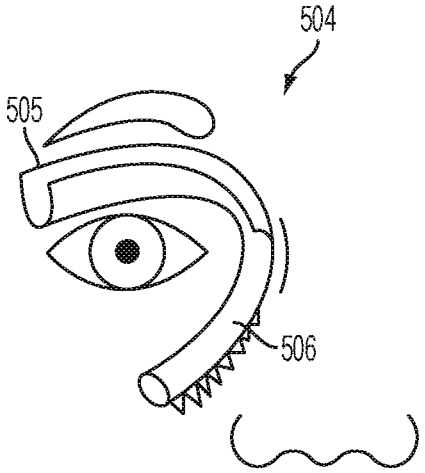

FIGS. 5A and 5B depict other variations of an adhesive wearable sweat-diverting device. Adhesive wearable sweat-diverting device (501) may be made of a flexible or stiff material, or a combination thereof, and may have one cross-section at one segment (502) of the device and another cross-section (503) at another cross section of the device. As illustrated in FIG. 5A, the adhesive wearable sweat-diverting device (501) may have a generally U-shaped cross section in a segment positioned to capture and divert sweat from reaching the eyes, and a generally circular cross-section in a segment positioned to divert sweat captured in another segment of the device, although, as described in detail below, additional cross-sections may be used. Such a transition in cross-section may enable a first segment of the device to perform at least one function, and a second or other segment to perform at least one function different from a function performed by the first segment. FIG. 5B illustrates an adhesive wearable sweat-diverting device (504) that may have at least one segment (505) adhesively coupled to the wearer and at least one other segment (506) not adhesively coupled to the wearer, e.g., not coupled to the wearer.

Figure 6A:
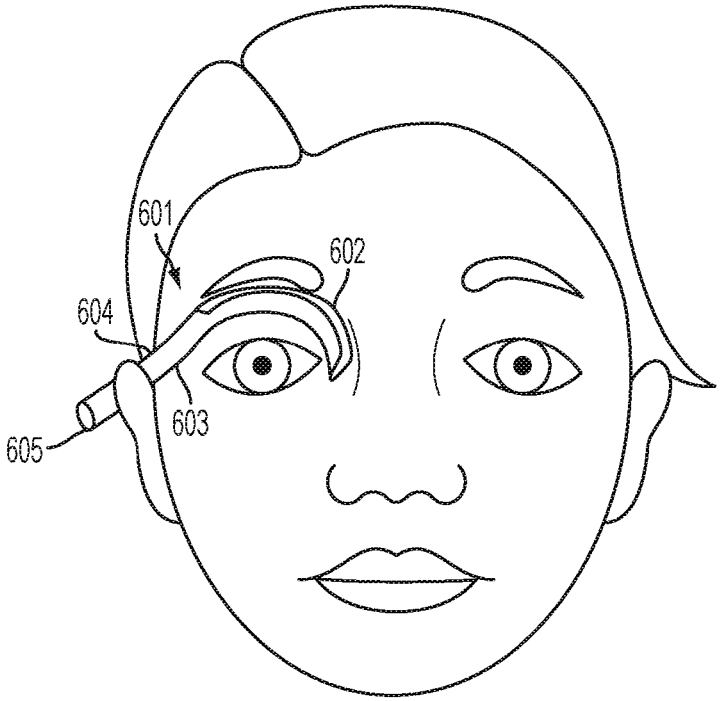
FIG. 6A depicts a front view of another variations of a sweat-diverting device.
Figure 6B:
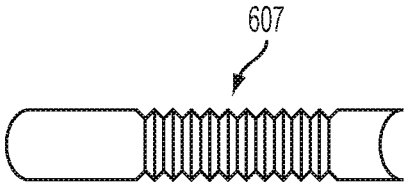
FIG. 6B depicts a bendable segment of a sweat-diverting device.
Figure 6C:
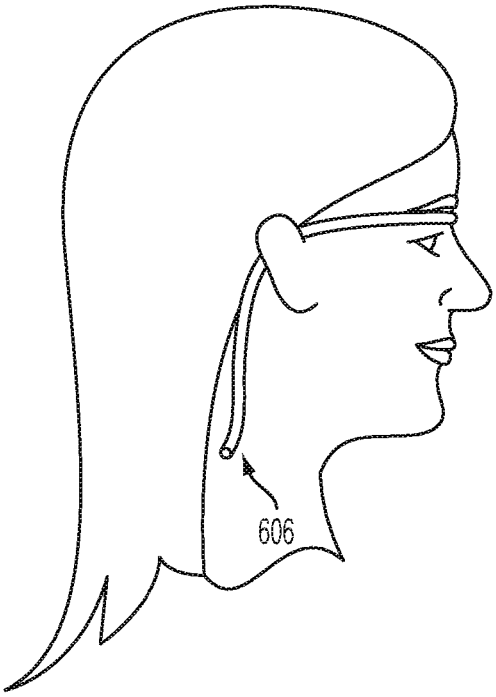
FIG. 6C depicts a side view of one variation of a sweat-diverting device.

One example of an adhesive wearable sweat-diverting device (601) which has at least one segment not adhesively coupled to the wearer is depicted in FIGS. 6A-6C. In one variation, the adhesive wearable sweat-diverting device (601) may have a first segment (602) with a generally U-shaped sweat-diverting channel in a portion that may be positioned above the wearer's eye, and a second or other segment (603) with a generally circular cross-section that may traverse the wearer's face and some of the wearer's hair. Such second or other segment may have at least one area (604) in which it is not adhesively coupled to the wearer so that it does not stick to the wearer's hair. The third or other segment may be positioned (605) to release captured sweat in an area where it may not irritate the wearer, such as behind the ear or back of the neck (606), as shown in FIG. 6C. A segment (607) of such a device may have a cross-section in a generally accordion shape in order to enable it to maintain a shape or directionality defined by the wearer (FIG. 6B). A first portion (602) of such device may have a preformed curve, which may be shaped to fit within the orbit and against the lateral side of the nose. Such preformed curved section (602) may further be partially deformable so that the device may fit wearers with different size orbits.

Figure 7A:
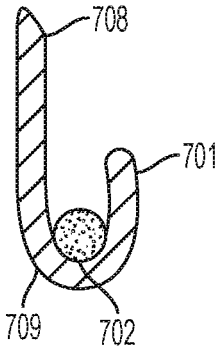
FIGS. 7A-7C depict various cross-sections of a sweat-diverting device.
Figure 7B:
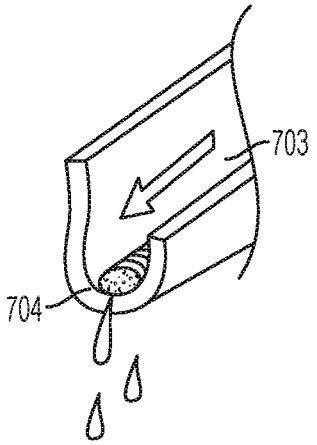
Figure 7C:
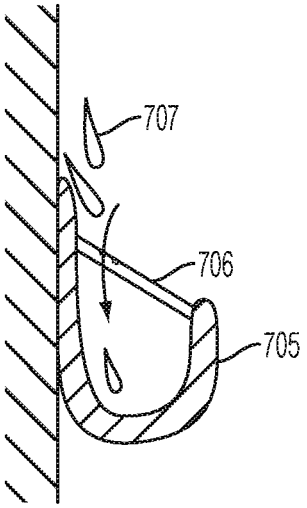

As mentioned above and described hereinthroughout, the sweat-diverting devices described herein may include one or more additional useful features. For example, FIGS. 7A-7C illustrate various sweat collecting channels of suitable sweat-diverting devices comprising one or more additional useful features. FIGS. 7A and 7B depict a channel (701) having a wicking or other absorbent material (702), e.g., a polymer wicking material. While shown in FIG. 7A as positioned such that it may guide sweat captured by the channel along the bottom of the channel (703) to prevent sweat from leaking out of the channel other than at the end of the channel (704), the absorbent material may be placed in any suitable location (e.g., at the top of the device (708) or at or near the outer bottom of device (709)). Alternatively the absorbent material may be placed outside the channel, for instance below the channel, to absorb and redirect sweat produced below the level of the device in use. Alternatively or additionally, a channel (705) may have a membrane or filter cover (706) which may allow sweat (707) to enter the channel and make it relatively more difficult for sweat to exit the channel in the reverse direction (FIG. 7C).

Figure 8A:
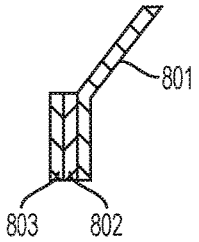
FIGS. 8A-8D schematically depict various adhesive mechanisms for a sweat-diverting device.
Figure 8B:
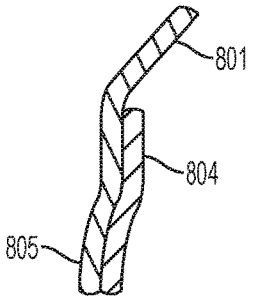
Figure 8C:
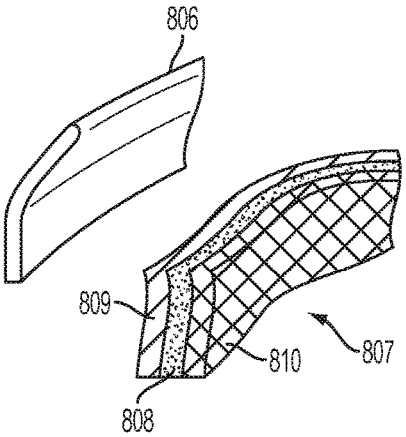
Figure 8D:
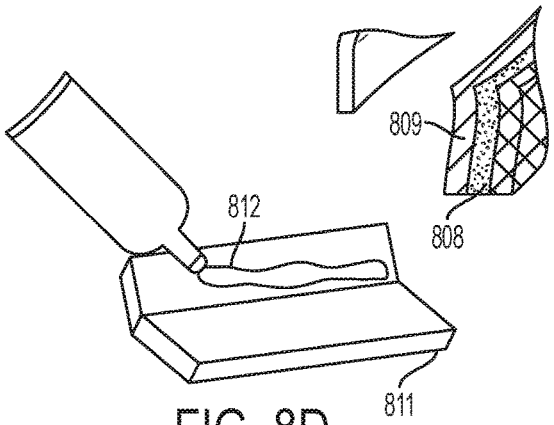

FIGS. 8A-8D depict several attachment mechanisms for use with the sweat-diverting devices described herein, for example, device (801). As shown in FIG. 8A, an adhesive attachment mechanism (802) may be applied at the time of manufacture and may be covered with a protective backing material or release liner (803) until the time of use. FIG. 8B depicts a flexible strip (804) with adhesive on one side, which may be applied at the time of manufacture or by the user prior to use, and the strip may have at least one portion where the adhesive is covered by a protective backing material (805) until the time of use. A wearable sweat-diverting device that has an adhesive mechanism applied at the time of manufacture may be intended for single use before disposal. For example, as illustrated in FIG. 8C, a wearable sweat-diverting device (806) intended for multiple uses prior to disposal may have an adhesive mechanism applied by the user at the time of use. An adhesive mechanism (807) may be a flexible strip (808) coated with adhesive on both sides, and the adhesive may be covered with protective backing material (809, 810) which may be removed prior to use. A first piece of backing material (809) may be removed first and the adhesive strip applied to the wearable sweat-diverting device (806). A second piece of backing material (810) may then be removed to expose the other adhesive surface, and the wearable sweat-diverting device applied to the wearer. FIG. 8D depicts a wearable sweat-diverting device (811) that may be used multiple times prior to disposable. The sweat-diverting device (811) may be attached to a wearer using a gel-based adhesive (812) mechanism, where the gel-based adhesive may be applied by the user at the time of use or integrated into the device at the time of manufacture. In some variations, the device may incorporate an adherent material that retains its adhesive properties over multiple uses. Other suitable adhesive materials include pressure sensitive adhesive materials, such as synthetic rubber/resin blends and acrylates, both of which are available from 3M. It should be understood that the adhesive need only cover various portions of the leg attaching to the wearer.

Figure 9:
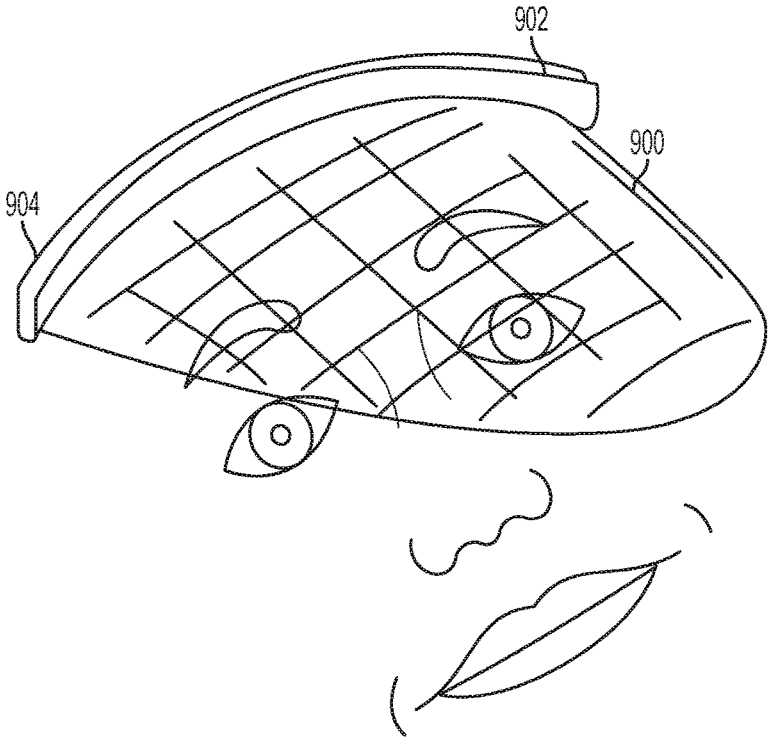
FIG. 9 depicts one variation of an adhesive sweat-diverting device comprising a shade element.
Figure 10A:
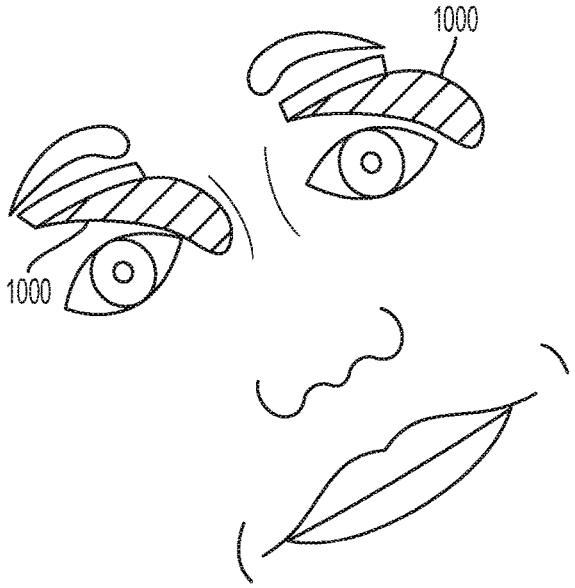
FIGS. 10A-10C depict another variation of an adhesive sweat-diverting device comprising a shade element.
Figure 10B:
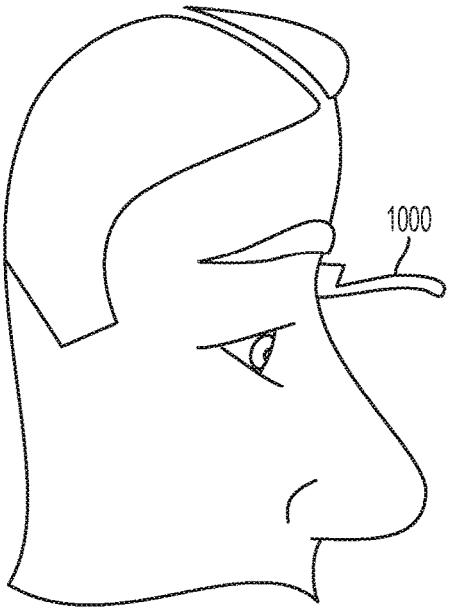
Figure 10C:
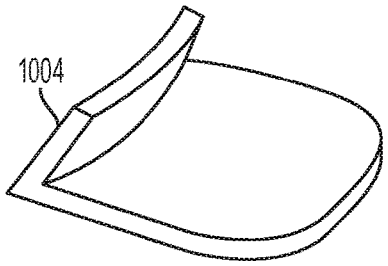

In some embodiments, an adhesive device may be configured to provide shade over the eyes, with or without a sweat-diverter. In some variations, the device is an adhesive sweat-diverting device configured to provide shade to the eyes. Such a device may comprise a shade element which may extend substantially perpendicularly from the face of the wearer and which may create a shade over the eye or eyes, for example, as schematically depicted in FIG. 9 and FIGS. 10A-10C, and FIGS. 12C and 12F. For instance, shade elements (900), (1000), (1207), and (1213) may protrude from the face of the wearer at an angle from about 45 to about 135 degrees. For example, about 45 to about 90 degrees, or about 90 degrees to about 135 degrees. In some variations, the angle is about 90 degrees. In some variations, the angle may be adjusted by the wearer during use (e.g., to accommodate changes in the wearer's position relative to the sun), or the angle may be pre-determined and fixed. Shade elements may be wide enough to shade both eyes (e.g., shade element (900)), or may be wide enough to shade only one eye (e.g., shade element (1000)). The shade elements (1000) of the adhesive sweat-diverting device illustrated in FIGS. 10A-10C may each have a curve that approximates the curvature of the eyes, which may help provide better shading from the sun. The length of the shade elements (900), (1000), (1207), and (1213) may be any suitable length such that the shadow it creates overlaps with the eye region of the wearer, or it may be adjustable by the wearer by tearing or cutting to a suitable length. The shade elements may be perforated for the purpose of enabling the tearing of the device to a desired length. Adhesive sweat-diverting devices with one or more shade elements may be sized and shaped to adhere to the wearer's skin in any of the positions described previously. For example, an adhesive sweat-diverting device may be positioned above the eyebrows, as shown in FIG. 9. Alternatively, adhesive sweat-diverting devices may be positioned between the eyebrows and the eyes, as shown in FIGS. 10A-10B. In some variations, the adhesive portions may be similar to one or more of the adhesives described above. For example, the adhesive portions (904), (1004) may comprise the entire skin-contacting surface of the device. Such a continuous adhesive region may help ensure that the device is securely attached to the wearer and may create a seal such that sweat does not leak into the wearer's eyes. Sweat-collection and/or sweat-diverting channels, such as sweat-collection channel (902) shown in FIG. 9, may be of any suitable configuration, as described above. For example, sweat-collection channel (902) may have a U-shaped shaped cross-section or a V-shaped cross-section, as depicted and described previously.

In other variations, adhesive sweat-diverting devices may not have a discrete sweat-collection or sweat-diverting channel, but may have one or more shade elements that are curved such that sweat is diverted away from the wearer, and across the contour of upper surface of the shade element(s). Such devices are depicted in FIGS. 11A-C and FIG. 12A, FIG. 12B, FIG. 12D, and FIG. 12E. As with all the devices described here, these devices may or may not have a continuous adhesive seal to the skin of the wearer. For example, the devices described here may have only intermittent adhesive portions. Since such adhesive shade devices do not circumscribe the head and only extend across a portion of the wearer's face, these adhesive shade devices may be positioned closer to the eyes (e.g., just above the eyebrows, and/or between the eyebrows and the eyes, etc.) if desirable. This may help to provide better shading from the sun. The device depicted in FIGS. 11A-11C has a width such that shade is provided to both eyes, but in other variations, the device may have a smaller width that is suitable for providing shade to just one eye and used in pairs, as shown in FIG. 10A. While these devices have been described and depicted as providing shade to the eyes, it should be understood that these devices may also be configured to shade other parts of the body, as may be desirable. For example, these devices may be configured to provide shade to the ears, nose, back of the neck, or any region of the arms or legs. These devices may also be used to shield and/or provide shade to sensitive regions of the body, for example, any cuts, scrapes, rashes, burns, areas of light sensitivity, etc.

Figure 11A:
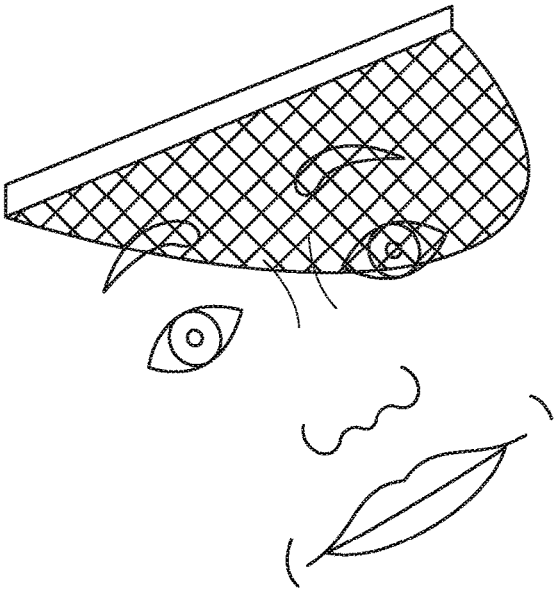
FIGS. 11A-11C depict one example of an adhesive shade device.
Figure 11B:
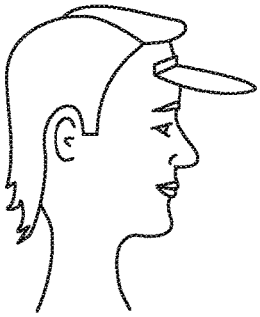
Figure 11C:
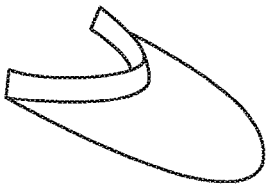
Figure 12A:
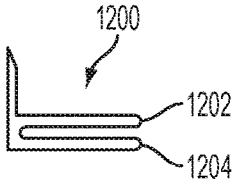
FIGS. 12A-12F depict additional illustrative variations of adhesive shade devices.
Figure 12B:
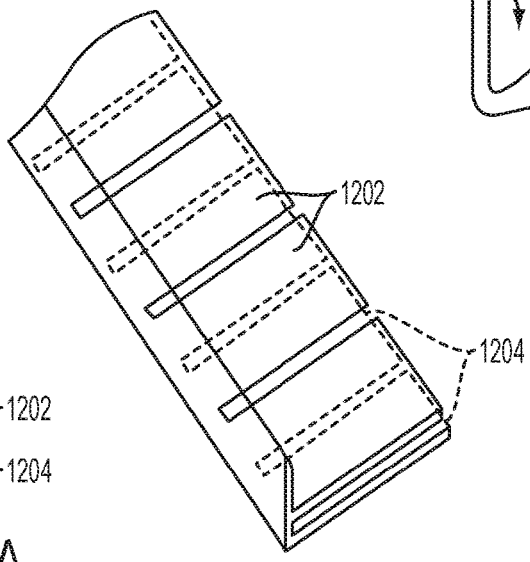
Figure 12C:
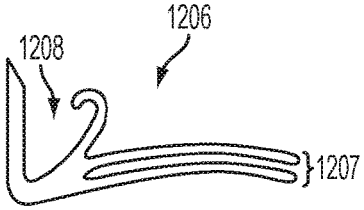
Figure 12D:
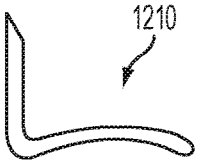
Figure 12E:
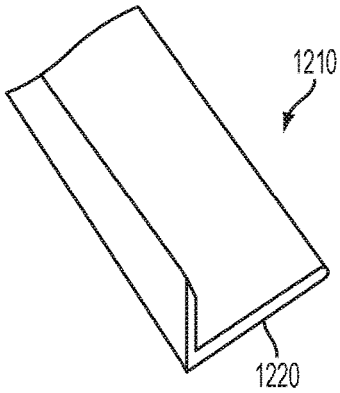
Figure 12F:
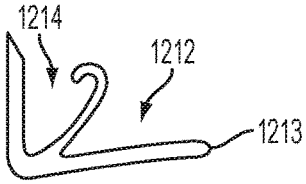

While FIGS. 11A-11C depict a variation, where the device provides shade substantially in the form of a visor, the shading portion of the device need not be that long, as seen for example, in the devices shown in FIGS. 12A-12F. FIG. 12A-12C depict a two-layered sun shade (1200) having off-set slots or tabs in each layer. The slots or tabs may or may not be made from one or more perforations or slots in the sun shading portions, and these portions may or may not be made from the same material or have the same thickness, width, or orientation. FIG. 12A shows a cross-sectional view of shade (1200), having two layers of off-set tabs (1202, 1204) and FIG. 12B provides a perspective view of shade (1200). In this variation, having off-set tabs (1202, 1204) may help the device conform more easily to the wearer's head without deformation. FIG. 12C provides a cross-sectional view of a two-layered sun shade (1206), here including a sweat diverting channel (1208). FIGS. 12D-12F show a single-layered sun shade embodiment. FIG. 12D shows a cross-sectional view of sun shade (1210), having one layer, FIG. 12E shows a perspective view of sun shade (1210), and FIG. 12F shows a cross-sectional view of sun-shade (1212) having a diverter channel (1214).

The invention claimed is:

1. An adhesive sweat-diverter configured to be worn above an eyebrow of a wearer without circumscribing the head, comprising:

two legs defining a channel for collecting sweat, and an adhesive portion coupled thereto, wherein the legs are flexible, such that the sweat-diverter is conformable to the wearer, and wherein the leg is made of a non-absorbent material, wherein the sweat-diverter has a first, generally linear, configuration without any pre-shaped curvature and a second, contoured, configuration.

2. The sweat-diverter of claim 1 having a generally J-shaped cross section.

3. The sweat-diverter of claim 1 wherein the two legs terminate at a same height.

4. The sweat-diverter of claim 1 having a minimum length of at least 5 inches.

5. The sweat-diverter of claim 1, wherein at least one leg comprises at least one aperture or slit.

6. The sweat-diverter of claim 1, wherein at least one leg is made from a material having a Shore A durometer in the range of about 5 to about 50.

7. The sweat-diverter of claim 1, wherein the adhesive is a pressure-sensitive adhesive.

8. The sweat-diverter of claim 1, wherein the pressure-sensitive adhesive is a synthetic rubber, an acrylate, or a combination thereof.

9. The sweat-diverter of claim 1 having at least one distinctive characteristic.

10. The sweat-diverter of claim 9, wherein the distinctive characteristic is color.

11. The sweat-diverter of claim 1, further comprising at least one sun-shading portion.

12. A method of diverting sweat comprising:

adhering a sweat-diverting device above an eyebrow of a wearer, without circumscribing the head of the wearer, wherein the sweat-diverting device comprises two legs defining a channel for collecting sweat, and an adhesive portion coupled thereto, wherein the legs are flexible, such that the sweat-diverter is conformable to the wearer, and wherein the legs are made of a non-absorbent material, and wherein the sweat-diverter has a first, generally linear, configuration without any pre-shaped curvature prior to being adhered to the wearer, and a second, contoured, configuration after being adhered to the wearer.

13. The sweat-diverter of claim 11, wherein the at least one sun-shading portion is configured to extend substantially perpendicularly from the face of the wearer and has a width suitable to create shade over at least one of the wearer's eyes.

14. The sweat-diverter of claim 13, further comprising at least two sun-shading portions.

15. The sweat-diverter of claim 14, wherein the at least two sun-shading portions are in at least a partially overlapping relationship to one another.

16. The sweat-diverter of claim 1, wherein the two legs are differently shaped.

17. The sweat-diverter of claim 1, wherein the lengths of the legs defining the channel are different.

18. The sweat-diverter of claim 1, wherein one of the legs curves inwards and/or comprises a lip facing in to the channel.

19. The sweat-diverter of claim 1, further comprising a segment with a first cross section and a segment with a second cross section, and wherein the first and second cross sections are different.

20. The sweat-diverter of claim 1, further comprising:

a wicking or other absorbent material; or a membrane or filter cover arranged so as to allow sweat to enter the channel and to make it relatively more difficult for sweat to exit the channel in the reverse direction.

* * * * *